United States Patent [19]

Yarema

[11] 4,281,573

[45] Aug. 4, 1981

[54] MANUAL VOLUME CONTROL DEVICE FOR GUITAR OR THE LIKE

[76] Inventor: Dennis W. Yarema, 9271 Thistle Rd., Anaheim, Calif. 92804

[21] Appl. No.: 82,377

[22] Filed: Oct. 5, 1979

[51] Int. Cl.[3] ..... G10H 3/00

[52] U.S. Cl. ..... 84/1.16; 84/1.27; 84/1.09

[58] Field of Search ..... 84/1.09, 1.16, 1.27; 74/89.17, 422

[56] References Cited

U.S. PATENT DOCUMENTS

| | | | |
|---|---|---|---|
| 425,693 | 4/1890 | Patterson | 74/89.17 |
| 2,207,341 | 7/1940 | Dickerson | 84/1.16 |
| 2,986,953 | 6/1961 | De Armond et al. | 84/1.27 |
| 3,159,706 | 12/1964 | Leslie | 84/1.27 |
| 3,290,424 | 12/1966 | Fender | 84/1.16 |

*Primary Examiner*—J. V. Truhe
*Assistant Examiner*—Forester W. Isen
*Attorney, Agent, or Firm*—John G. Mesaros

[57] ABSTRACT

A manual volume control device for an electric guitar having a pinion gear attached to the shaft of the volume control. A rack is slidably mounted relative to the surface of the guitar for meshingly engaging the pinion gear. A handle member is coupled at one end thereof to the rack with the other end of the handle member extending to the strumming area of the guitar and configured for grasping by the hand of the guitarist for linearly actuating the volume or tone control to produce a violin type tone during playing of a musical piece.

6 Claims, 3 Drawing Figures

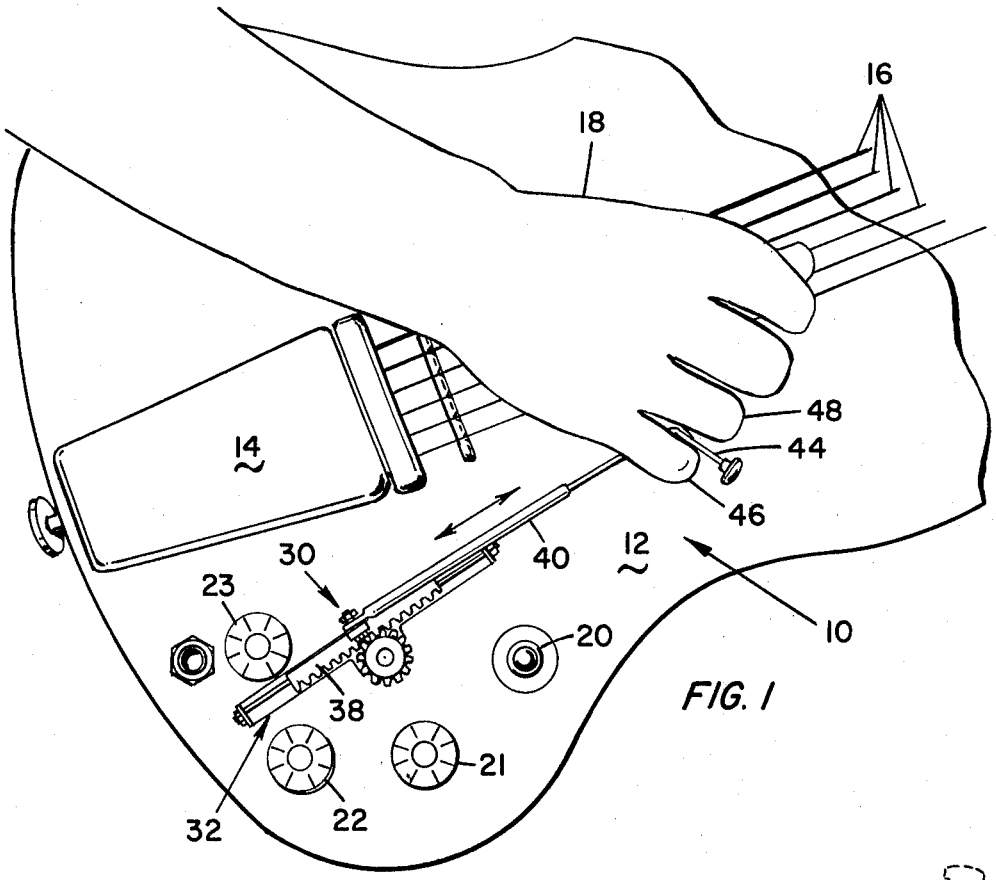
FIG. 1
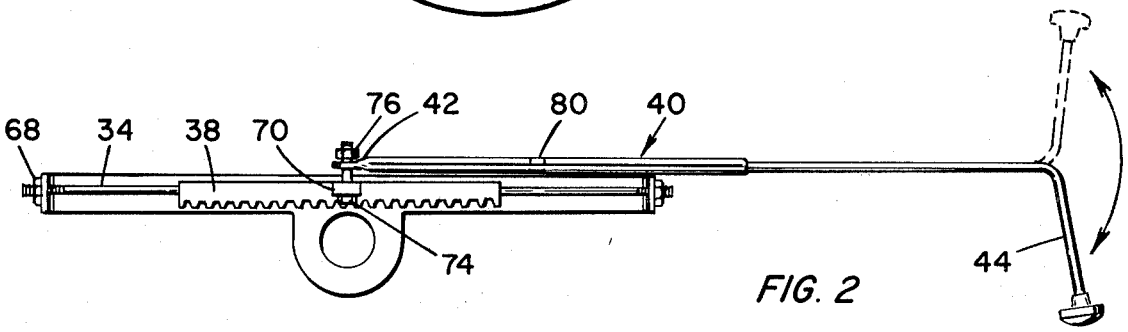
FIG. 2
FIG. 3
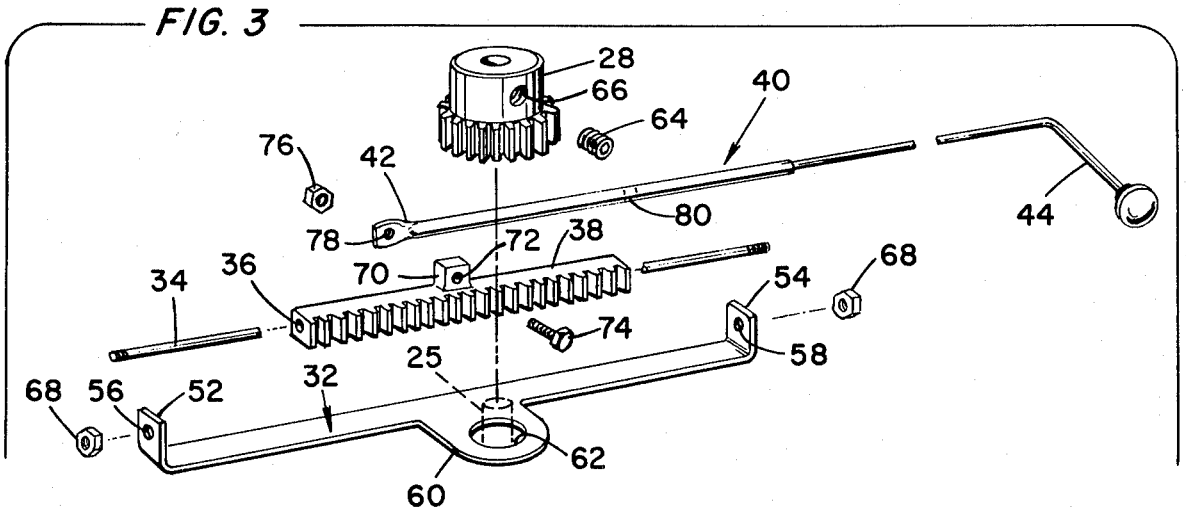

MANUAL VOLUME CONTROL DEVICE FOR GUITAR OR THE LIKE

BACKGROUND OF THE INVENTION

The background of the invention will be discussed in two parts:

1. Field of the Invention

This invention relates to accessories for electric guitars and more particularly to a manual volume or tone increaser or decreaser operable by the guitarist without removing the hand from the strumming area of the guitar.

2. Description of the Prior Art

Electric guitars are provided with volume and tone controls on the surface of the guitar usually at a position remote from the strumming area. In the playing of electric guitars, to achieve certain effects, often times the guitarist manually increases or decreases the volume or tone during the play of a musical piece thus necessitating the removal of the hand from the strumming area to effect rotation of the volume or tone control knob while a particular note is still being emitted with the hand then returning very quickly to the strumming area to proceed the play of the musical piece.

Accessory devices have been built to facilitate this volume or tone control, such devices usually taking the form of foot operated devices which thereby enable the guitarist to maintain the hand in the playing position while effecting the changes of volume or tone during the play of the piece.

In playing an electric guitar, in order to obtain a pure simulated violin type tone, it is necessary that the volume control, for example, be increased or decreased linearly. That is, spasmodic or intermittent actuation of the volume control by hand or by foot will preclude the desired effect.

When attempting to effect a violin-type tone manually, the guitarist usually uses one finger to quickly rotate the volume, for example, from zero to maximum, and then perhaps back to zero or some point in between. However, such movement may be erratic or spasmodic or totally missed thus precluding the desired effect.

With respect to pedally operated devices, the foot lacks the sensativity of the hand in creating such an effect, particularly if a prolonged violin-type tone is desired. Furthermore, with such foot operated devices, cords, batteries or electronics are usually required.

It is an object of the present invention to provide a manual volume increaser or decreaser for an electric guitar that provides a linear volume boost.

It is another object of the present invention to provide a new and improved accessory for an electric guitar to provide volume/tone control by the guitarist without removal of the hand from the strumming area.

It is another object of the present invention to provide a new and improved accessory for an electric guitar which requires no electrical connections and is readily attachable to existing electric guitars.

SUMMARY OF THE INVENTION

The foregoing and other objects of the invention are accomplished by providing a first member in the form of a pinion gear for attachment to the shaft of the sound control knob. A second member is slidably mounted relative to the surface of the guitar, the second member being a rack meshingly engaging the pinion gear. The slidable mounting is accomplished by means of a support member having a shaft secured at opposite ends thereof with the shaft extending through an aperture in the rack member. A handle is provided with one end secured to the rack with the other end being configured for being received between the fingers of the guitarist. When a particular note is picked with the volume or sound control in zero position, the lever is instantly pulled towards the guitar neck and the linear volume increase produces a violin-type tone without the hand of the guitarist leaving the strumming area of the guitar. The lever may be telescoping, hinged or otherwise articulated to permit the folding back thereof when the use of the accessory device is not needed.

Other objects, features and advantages of the invention will become apparent from the reading of the specification when taken in conjunction with the drawings in which like reference numerals refer to like elements in the several views.

DESCRIPTION OF THE DRAWINGS

FIG. 1 is a partial perspective view of an electric guitar illustrating the manual sound control device of the invention mounted thereon for use by the guitarist;

FIG. 2 is a top plan view of the manual sound control device according to the invention; and FIG. 3 is an exploded perspective view illustrating the components of the device of FIG. 2.

DESCRIPTION OF THE PREFERRED EMBODIMENT

Referring now to the drawings and particularly to FIG. 1 there is shown an electric guitar generally designated 10 having an upper surface or face 12 having mounted thereon a tailpiece generally designated 14 with a plurality of guitar strings 16 extending therefrom toward a neck portion (not shown) in conventional fashion. The hand 18 of the guitarist, during play, is positioned over the strings 16 to strum or pick one or more of the strings 16 during play of a musical composition. The area at which the hand 18 is located as shown in FIG. 1 is hereinafter referred to as the strumming area of the guitar.

In an electric guitar, extending through the face 12 at a position remote from but proximate to the strumming area are a plurality of shafts which receive rotatable control knobs 20–23, the rotation of which controls certain perameters of the sound being emitted such as tone or volume. These knobs 20–23 are conventionally used to actuate potentiometers in electrical circuit relation with pickups or transducers (not shown) usually extending through the face 12 of the guitar 10 beneath the strings 16 in the strumming area of the guitar.

A fifth control which may be tone or volume has the shaft 25 thereof (shown in dotted lines in FIG. 3) receiving a pinion gear member 28, rotation of the pinion gear member 28 effecting the desired volume or tone control.

In a preferred embodiment, the pinion gear 28 is preferably coupled to the shaft of a volume control, rotation of this volume control in a linear manner from zero to maximum producing a violin-type tone for a given note emitted by a particular string 16 which is pricked by the guitarist with subsequent actuation or rotation of the pinion gear member 28.

The accessory device for accomplishing this result is generally designated 30 and, in addition to the pinion gear 28, includes a base or support member 32 (see FIGS. 2 and 3) having suspended from opposite ends thereof a rod or shaft 34 extending through an elongate aperture 36 in a rack member 38 to provide slidable movement of the rack member. A handle generally designated 40 has one end 42 thereof suitably secured to the rack member 38 with the other end or free end 44 of the handle 40 being configured to be received between the little finger 46 and ring finger 48 of the hand 18 of the guitarist (as shown in FIG. 1).

Structurally, the support member 32 is a generally bar-shaped member having the opposite ends 52 and 54 thereof bent upwardly at generally right angles to the base portion with each of the ends 52 and 54 having apertures 56 and 58 respectively passing therethrough. Extending outwardly in planar relation with the base portion of the support member 32, there is a projection 60 having an enlarged aperture 62 therein for passage therethrough of the shaft 25 of the electrical sound control such as the volume potentiometer. Conventionally, the electrical volume control potentiometers are provided with a threaded neck extending through the face 12 of the guitar 10, this threaded neck receiving a nut for retaining the volume control potentiometer in position with the knob then being affixed to the shaft 25. The aperture 62 of the projection 60 is sufficiently large to accomodate this threaded neck portion and permit securing of the support member 32 to the face 12 of the guitar 10 prior to securing the pinion gear 28 to the shaft 25 by means of a conventional set screw 64 passing through a threaded aperture 66 in the periphery of the pinion gear 28 to secure the pinion gear 28 relative to the shaft 25.

As best illustrated in FIG. 3, the shaft 34 extends through the aperture 36 of the rack 38 with both ends of shaft 34 being suitably threaded for extending through the aligned apertures 56 and 58 in the ends 52 and 54 of the support member 32. These threaded ends of shaft 34 then receive suitable fastening means such as nuts 68 to maintain the shaft 34 in fixed relation to the support member 32 in generally parallel relation to the face 12 of the guitar 10.

As an alternative to this structure, for newly manufactured guitars 10, the face 12 may be optionally provided with upwardly extending lugs in spaced relation to correspond to the ends 54 and 56 of the support member 32 for retaining the shaft 34 and rack member 38 in slidable generally parallel relation with the face 12 of the guitar 10 with the rack 38 in meshing engagement with the pinion gear 28 as illustrated in FIG. 1.

To enable manual control, the rack member 38 at the approximate bit point thereof is provided with an upwardly extending lug portion 70 having an aperture 72 extending therethrough for receiving suitable fastening means such as screw 74 and nut 76 which extends through an opening 78 in the end 42 of the handle 40. As shown in FIG. 2, the accessory device is shown in assembled condition prior to mounting on the guitar 10. The handle 40 is illustrated as a telescoping two-part handle to permit retraction or shortening of the handle to remove it from use when so desired. Alternatively, or in addition, the handle 40 may be suitably hinged such as at the midpoint designated 80 between the dotted lines to enable the folding back of the handle 40 when not in use. When so folded back or telescoped, the volume control can still be effected on a selective basis by manually rotating the pinion gear 28 to the desired position.

To assemble the accessory device, the control knob (such as any one of the knobs 20–23) is removed from the shaft of the corresponding control knob. The nut (not shown) securing that control potentiometer to the face 12 of the guitar10 is then removed. The aperture 62 of the projection 60 of the support member 32 is then placed over the extending threaded neck portion of the control knob and the nut is replaced to secure the support member 32 to the face 12 of the guitar 10. With the rack member 38 moved to its rearmost position and the shaft 25 rotated fully counterclockwise (corresponding to the zero volume position) the pinion 28 is then positioned over shaft 25 in meshing engagement with the leading end of rack 38. The set screw 64 is then tightened down to secure pinion 28 to shaft 25.

During play, the handle 40 is extended to the maximum position (or unfolded as the case may be) with the end 44 of the handle 40 fitting between the little finger 46 and ring finger 48 of the hand 18 of the guitarist (as shown in FIG. 1). When it is desired to produce a violin-type tone, a particular one of the strings 16 is picked and the operator then moves the hand 18 in the forward direction (toward the neck) to thereby slidably move the rack member 38 and rotate the pinion member 28 in a clockwise direction to increase the volume during persistence of the thus picked note. Since the musician is capable of fine control with the hands, a truly linear activation results. In addition, the accessory device according to the invention can produce an organ-type effect when a chord is played by strumming a number of strings 16 with the handle 40 being linearly moved in either direction as indicated by the double ended arrow adjacent thereto in FIG. 1, thus providing a tremolo or vibrato effect.

The rack and pinion have the dimensions and number of teeth so selected, and the distance of slidable movement of the rack 38 is so selected to provide maximum rotation of the shaft 25 of the potentiometer, this rotation being in the neighborhood of 270° to 300° of travel. The position and dimensions of the various parts must be sufficient to enable the handle 40 to clear any obstacles such as extensions of the tailpiece 14. That is, the height of the handle 40 from the face 12 of the guitar 10 must be sufficient to provide clearance while still providing accessability to the hand 18 of the guitarist to enable sliding movement of the rack 38 without removal of the hand 18 from the strumming area of the guitar 10.

As an alternative to the rack and gears shown in the drawings, the rotatable member, that is the pinion gear member 28 may be replaced by a control knob having a serrated or other friction type periphery. The rack member 38, in lieu of gear teeth, may likewise be provided with a mating coacting frictional surface which may likewise be serrated or provided with a frictionally engaging surface. Also, as previously discussed, lugs may be formed integrally with the face 12 of the guitar 10 to eliminate the support member 32 while providing means for supporting the shaft 34 for providing slidable movement of the slidable member or rack member 38 in accordance with the invention.

In accordance with the invention, there has been shown and described a manual sound control device which can be implemented integral with or as an accessory to a guitar. The device provides a low cost, mechanically simple accessory which is less cumbersome than the foot-operated devices currently available. Furthermore, the device requires no cords, batteries or electronics. With the normal sensitivity of the hand of the guitarist, a truly linear volume or tone control may be effected by the hand of the guitarist without removal of the hand from the strumming area of the guitar. While there has been shown and described a preferred embodiment, it is to be understood that various other adaptations and modifications may be made within the spirit and scope of the invention.

What is claimed is:

1. In a device for use with an electric guitar having electrical controls with rotatable shafts extending through the face thereof, the combination comprising:

a first member configured for being received on the shaft of an electrical control;

a support member configured for securing to the face of the guitar in proximate relation to said shaft, said support member having a rod affixed thereto in generally parallel relation to the face of the guitar;

a second elongate member with an elongate aperture therein slidably mounted on said rod in abutting relation with said first member, the abutting surfaces of said first and second members matingly coacting to effect rotation of said first member in response to linear movement of said second member; and handle means having one end thereof coupled to said second member and the other end thereof configured for being received between the fingers of the hand of the guitarist with the hand positioned at the strumming area of the guitar for enabling rotation of the shaft of the control by the guitarist with the hand in proximity to the strumming area whereby to produce varying type sounds from a picked guitar string in response to linear movement of said second member by the guitarist.

2. The combination according to claim 1 wherein said first member is a pinion gear and said second member is a rack member.

3. The combination according to claim 2 wherein said handle means is collapsible.

4. The combination according to claim 2 wherein said handle means is a telescoping handle.

5. The combination according to claim 2 wherein said handle means is foldable.

6. The combination according to claim 1 wherein said support member has upwardly extending ends with apertures therethrough for receiving said rod in generally parallel relation to the face of the guitar, said support member further including a generally centrally located projection having an aperture therefor for passage therethrough of the shaft of the control.

* * * * *